US007721693B2

(12) United States Patent
Nguyen et al.

(10) Patent No.: US 7,721,693 B2
(45) Date of Patent: May 25, 2010

(54) METHOD FOR ADJUSTING THE ROTATIONAL ANGLE POSITION OF THE CAMSHAFT OF A RECIPROCATING INTERNAL COMBUSTION ENGINE IN RELATION TO THE CRANKSHAFT

(75) Inventors: Minh Nam Nguyen, Buhl (DE); Heiko Dell, Buhlertal (DE); Holger Stork, Buhl (DE)

(73) Assignee: Schaeffler KG, Herzogenaurach (DE)

( * ) Notice: Subject to any disclaimer, the term of this patent is extended or adjusted under 35 U.S.C. 154(b) by 181 days.

(21) Appl. No.: 12/169,907

(22) Filed: Jul. 9, 2008

(65) Prior Publication Data

US 2009/0007865 A1 Jan. 8, 2009

Related U.S. Application Data

(63) Continuation of application No. 11/576,299, filed as application No. PCT/DE2005/001695 on Sep. 24, 2005, now abandoned.

(30) Foreign Application Priority Data

Oct. 6, 2004 (DE) ..... 10 2004 048 528

(51) Int. Cl.
*F01L 1/34* (2006.01)

(52) U.S. Cl. ..... 123/90.17; 123/90.15; 123/347; 123/406.63; 123/406.59; 464/160; 701/105

(58) Field of Classification Search ..... 123/90.15, 123/90.16, 90.17, 90.18, 345, 347, 406.12, 123/406.58, 406.59, 406.63, 406.64; 464/1, 464/2, 160; 701/101, 102, 105, 110
See application file for complete search history.

(56) References Cited

U.S. PATENT DOCUMENTS 7,222,593 B2 5/2007 Stork et al.
7,451,730 B2 * 11/2008 Nguyen et al. ..... 123/90.17

FOREIGN PATENT DOCUMENTS

| | | |
|---|---|---|
| DE | 4110195 | 10/1992 |
| JP | 2003129806 | 5/2003 |
| JP | 2004257249 | 9/2004 |
| WO | 2004038200 | 5/2004 |

* cited by examiner

*Primary Examiner*—Ching Chang
(74) *Attorney, Agent, or Firm*—Volpe and Koenig, P.C.

(57) ABSTRACT

A method for adjusting the rotational angle position of the camshaft (3) of a reciprocating piston internal combustion engine relative to the crankshaft (5) is provided. The crankshaft (5) is drivingly connected to the camshaft (3) via an adjusting drive (1), which is embodied as a triple-shaft gear mechanism, having a crankshaft-fixed drive shaft, a camshaft-fixed output shaft, and an adjustment shaft drivingly connected to an electric motor (4). A stop element is connected to the drive shaft and a counter-stop element is connected to the camshaft (3). The crankshaft rotational angle measuring signal and a position signal for the rotational angle of the adjusting shaft are detected during the starting step of the internal combustion engine. A phase angle signal for the position of the rotational angle of the camshaft (3), based on the initial position, in relation to the camshaft (3) is determined with the aid of the angle measuring signal, the position measuring signal and a gear variable of the triple shaft gear. After immobilization of the crankshaft (5) and the camshaft (3) in a reference position in relation to each other and after detection of the reference position, the phase angle in relation to the reference position is measured and is controlled to a target value signal.

11 Claims, 3 Drawing Sheets

METHOD FOR ADJUSTING THE ROTATIONAL ANGLE POSITION OF THE CAMSHAFT OF A RECIPROCATING INTERNAL COMBUSTION ENGINE IN RELATION TO THE CRANKSHAFT

BACKGROUND

The invention relates to a method for adjusting the rotational angle position of the camshaft of a reciprocating piston internal combustion engine relative to the crankshaft, especially during a startup process of the internal combustion engine, wherein the crankshaft is drivingly connected to the camshaft via an adjustment gear mechanism, which is constructed as a triple-shaft gear mechanism with a crankshaft-fixed drive shaft, a camshaft-fixed output shaft, and an adjustment shaft that is drivingly connected to an electric motor.

Such a method is known from DE 41 10 195 A1. Here, the rotational angle position of the camshaft relative to the crankshaft is adjusted with the help of an electric motor that drives an adjustment shaft of a triple-shaft gear mechanism, with this adjustment shaft being arranged between the crankshaft and the camshaft. A camshaft gear, which is driven via a chain by a crankshaft gear locked in rotation with the crankshaft, is provided on the drive shaft of the triple-shaft gear mechanism. The output shaft of the triple-shaft gear mechanism is locked in rotation with the camshaft. To adjust the rotation or phase position of the camshaft relative to the crankshaft to a preset desired value signal, the phase angle is measured and compared with the desired value signal. When a deviation appears, the electric motor is controlled so that the deviation is reduced. So that the engine function can be maintained even in the case of a fault in the adjustment device, the relative adjustment is limited to a maximum adjustment angle with the help of a stop element, which is connected to the drive shaft and which interacts with a camshaft-fixed counter stop element. In the case of a fault, the stop element is positioned against the counter stop element and thus the camshaft and the crankshaft are braced relative to each other. In comparison to a corresponding reciprocating piston internal combustion engine, which is operated at a constant phase position, better cylinder filling is achieved, which saves fuel, reduces pollutant emissions, and/or can increase the output power of the internal combustion engine. This applies to the startup process of the internal combustion engine, however, only because, in part, no measurement values for the phase position of the camshaft are present during the startup process.

SUMMARY

Therefore, there is the objective of providing a method of the type noted above, which allows low pollutant emissions and low fuel consumption during the startup process of the internal combustion engine.

This objective is met for a method of the type noted above, in that a) a rotational angle measurement signal is set to a rotational angle measurement signal start value, b) the crankshaft is rotated and a crankshaft sensor signal is detected, which changes its state for a change in the rotational angle of the crankshaft, c) for an occurrence of a state change in the crankshaft sensor signal, the rotational angle measurement signal is advanced, d) a position measurement signal is set to a position measurement signal start value, e) the adjustment shaft rotates and an adjustment shaft sensor signal is detected, which changes its state for a change in the rotational position of the adjustment shaft, f) for an occurrence of a state change of the adjustment shaft sensor signal, the position measurement signal is advanced, g) a phase angle signal for the rotational angle position of the camshaft relative to the crankshaft is determined with the help of the rotational angle measurement signal, the position measurement signal, and a gear parameter of the adjustment gear mechanism, h) the crankshaft and the camshaft are braced in a reference position relative to each other and the attainment of the reference position is detected, when the reference position is detected, the phase angle signal is set to a reference value allocated to the reference position, k) then the phase angle signal is advanced for a state change of the rotational angle measurement signal and/or the position measurement signal, l) and the phase angle is controlled, in that the reference position-related phase angle signal obtained in this way is compared with a desired value signal and when a phase angle deviation occurs, the electric motor is controlled such that the deviation is reduced.

The phase angle signal is determined indirectly from a rotational angle measurement signal for the crankshaft, a position measurement signal for the adjustment shaft, and a gear parameter, namely the gear ratio that the triple-shaft gear mechanism exhibits for a stationary drive shaft between the adjustment shaft and the camshaft. Therefore, the usually relatively high resolution of a position sensor for determining the position of the adjustment motor rotor relative to the stator can be used for measuring the phase angle signal. Because there is initially no information on the crankshaft rotational angle and the rotational angle position of the adjustment shaft when the internal combustion engine is started, the rotational angle measurement signal and the position measurement signal are set to start values that can be arbitrary. Starting from the corresponding start value, the rotational angle measurement signal is advanced when the crankshaft sensor signal changes its state. However, because the knowledge of the rotational angle position of the camshaft relative to the crankshaft is necessary for the regulation of the phase angle, the crankshaft and the camshaft are braced relative to each other in a reference position and the attainment of the reference position is detected with a sensor. When the reference position is reached, the phase angle signal is set to a given reference value, which was determined previously through a measurement or in another way and was stored, for example, in a non-volatile memory. Starting from this reference value, which corresponds to the relative position of the camshaft to the crankshaft at the reference position, the phase angle signal is advanced as a function of the state changes of the rotational angle measurement signal and the position measurement signal. With the help of the phase angle signal provided now, the phase angle is controlled to a preset desired value signal. Thus, a phase angle correction is possible relatively early, namely shortly after reaching the reference position, whereby correspondingly small pollutant emissions and low fuel consumption is enabled during the startup process of the internal combustion engine.

For a preferred embodiment of the invention, for bracing the crankshaft with the camshaft, a stop element connected to the drive shaft is positioned against a counter stop element connected to the camshaft. The method can then be performed with the help of a camshaft adjustment device that can be produced economically.

In another embodiment of the invention, the crankshaft and the camshaft are braced together with the help of at least one spring element. Here, the spring element can be arranged in the reference position in a neutral or central position.

Preferably, the attainment of the reference position is detected with reference to a change in the rate of change of the phase angle signal. However, it is also conceivable to identify the attainment of the reference position such that a torque is applied and tested with the electric motor whether the phase angle signal maintains its value before, during, and/or after applying the torque.

For an advantageous embodiment of the invention, when a preset reference rotational angle position of the crankshaft is reached, a reference mark is generated in the crankshaft sensor signal, wherein when the reference mark appears, a second rotational angle measurement signal is set to a value allocated to the reference rotational angle position, wherein the second rotational angle measurement signal is advanced when a state change of the crankshaft sensor signal appears, wherein a camshaft reference signal is generated when a preset rotational angle position of the camshaft is reached, wherein the measurement values of the rotational angle measurement signal and the position measurement signal present when the camshaft reference signal appears are determined and a value for an absolute phase angle signal is determined with these measurement values and the gear parameter, wherein the rotational speed of the internal combustion engine is measured and compared with a preset rotational speed threshold value and when the rotational speed threshold value is exceeded, the phase angle is corrected with the absolute phase angle signal as the actual value signal. Here, the crankshaft sensor signal is determined preferably with the help of a stationary magnetic detector, which is arranged, for example, on the engine block of the internal combustion engine and which interacts with a magnetically conductive toothed ring locked in rotation on the crankshaft. One of the teeth and/or tooth gaps of the toothed ring differs from the other teeth or tooth gaps of the toothed ring and is used as a reference for the absolute determination of the crankshaft rotational angle. The camshaft reference signal can be generated with the help of a trigger device as a function of the absolute rotational position of the camshaft. The second rotational angle measurement signal derived from the camshaft reference signal and the absolute crankshaft sensor signal has the advantage relative to the first rotational angle measurement signal relative to the reference position that tolerances and/or wear in the camshaft drive (crankshaft gear, drive chain, or toothed belts, chain or toothed belt tensioners, camshaft gear, stop and counter stop element) do not influence the accuracy of the rotational angle measurement. Thus, through the switching of the phase angle correction from the reference position-related phase angle signal to the absolute phase angle signal, the accuracy of the phase angle adjustment can be further improved.

It is advantageous if at least one rotational speed measurement value is initially detected for the rotational speed of the crankshaft and then afterwards only if the control of the phase angle is continued with the absolute phase angle signal. In this way it is avoided that at low rotational speeds, at which, with the help of a magnetic detector interacting with the crankshaft gear, no rotational speed measurement values can be measured, implausible values of the absolute phase angle signal cause positioning errors of the camshaft.

In a preferred construction of the method, the electric motor is set—before the reference position is reached—with a given pulse-to-no-current ratio in the direction of the reference position through pulse-width modulation. As long as there are no usable measurement values for the phase position, the electric motor is initially controlled "blindly." Here the pulse-to-no-current ratio is selected so that damage of the stop element and the counter stop element are reliably prevented independent of the position, in which it is located when the internal combustion engine starts.

For a preferred embodiment of the invention, the pulse-to-no-current ratio is changed as a function of the detection of the rotational speed measurement value, wherein the pulse-to-no-current ratio is preferably increased as soon as the rotational speed measurement value is detected. The value, at which the pulse-to-no-current ratio is increased can be selected as a function of at least one parameter, e.g., the engine temperature of the internal combustion engine and thus the drag losses in the valve train. The rotational speed measurement value is preferably detected starting at a crankshaft rotational speed of approximately 50 rpm.

It is advantageous if the phase position signal is differentiated for forming a phase velocity signal before positioning the stop element against the counter stop element, if the phase velocity signal is compared with a phase velocity threshold value, and if the phase velocity signal is compared with a desired value signal. For the case that the phase velocity signal is greater than the threshold value, the phase velocity signal is compared with a desired value signal, and if a deviation appears the electric motor is controlled, such that the deviation is reduced. Here, it is assumed that the measurement values for the phase velocity exist with accuracy sufficient for phase velocity regulation if the phase velocity signal exceeds the threshold value. Through the phase velocity regulation, the wear on the stop element and the counter stop element can be reduced and/or destruction of these parts can be prevented.

For a preferred embodiment of the invention, the operating current and/or the operating voltage and/or the rotational speed of the electric motor is limited and/or controlled before the attainment of the reference position is detected. Therefore, the force, with which the stop element is positioned during the start process of the internal combustion engine against the counter stop element, and thus the wear on the stop element or the counter stop element is limited. Furthermore, destruction of these parts is prevented.

BRIEF DESCRIPTION OF THE DRAWINGS

An embodiment of the invention is explained in more detail below with reference to the drawing. Shown are.

DETAILED DESCRIPTION OF THE PREFERRED EMBODIMENTS

Figure 1:
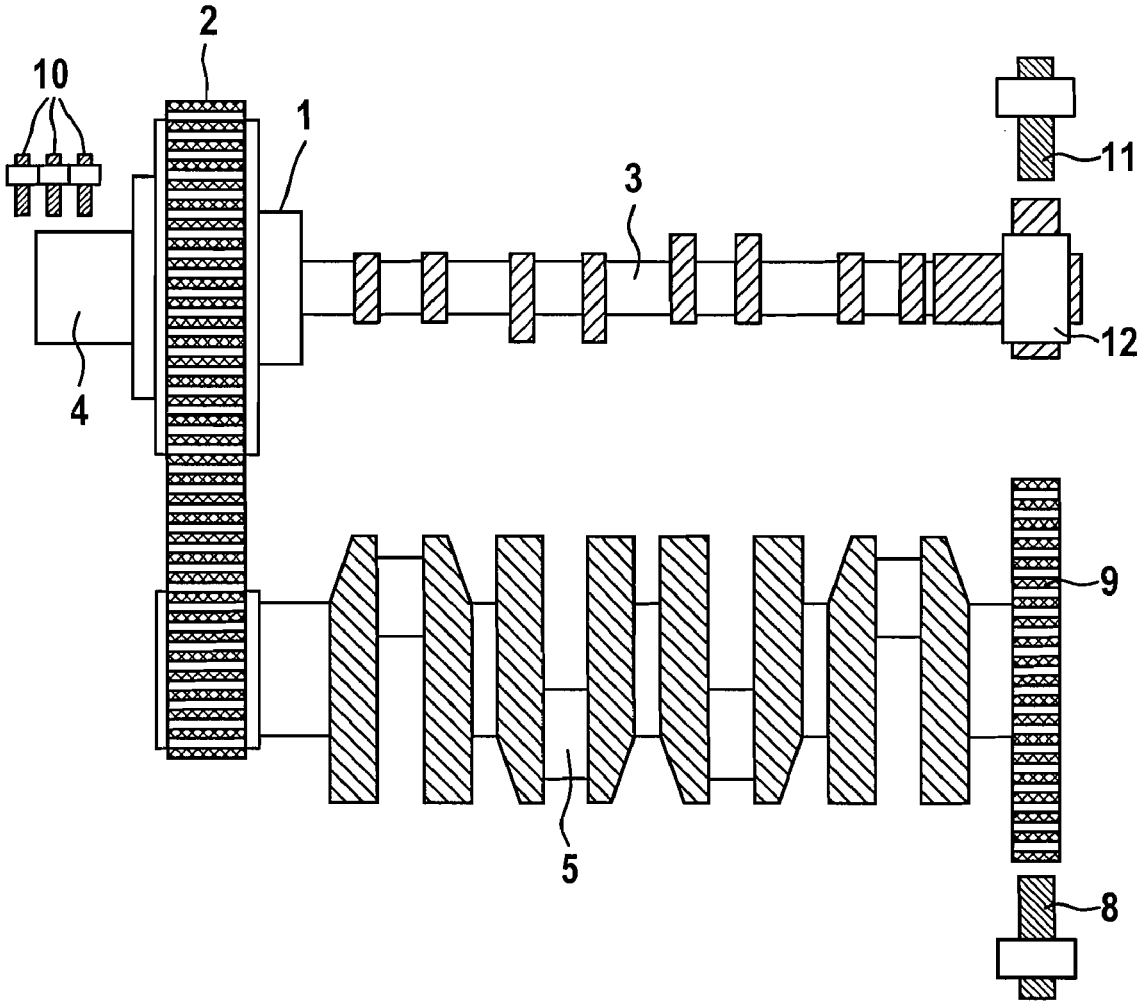
FIG. 1 a schematic partial representation of a reciprocating piston internal combustion engine, which has a device for adjusting the phase position of the camshaft relative to the crankshaft, FIG. 2 a view of a camshaft adjustment device, FIG. 3 a graphical representation of a state signal for the regulation of the phase position of the camshaft relative to the crankshaft, wherein time is plotted in seconds on the abscissa and the state is plotted on the ordinate, FIG. 4 a graphical representation of an idealized rotational speed profile of an internal combustion engine, wherein time is plotted in seconds on the abscissa and the rotational speed is plotted in revolutions/min on the ordinate, FIG. 5 a graphical representation of the actual phase angle (line marked by plus sign) and a desired value signal (unmarked line) for the phase angle, wherein time is plotted in seconds on the abscissa and the phase angle is plotted in degrees on the ordinate.
Figure 2:
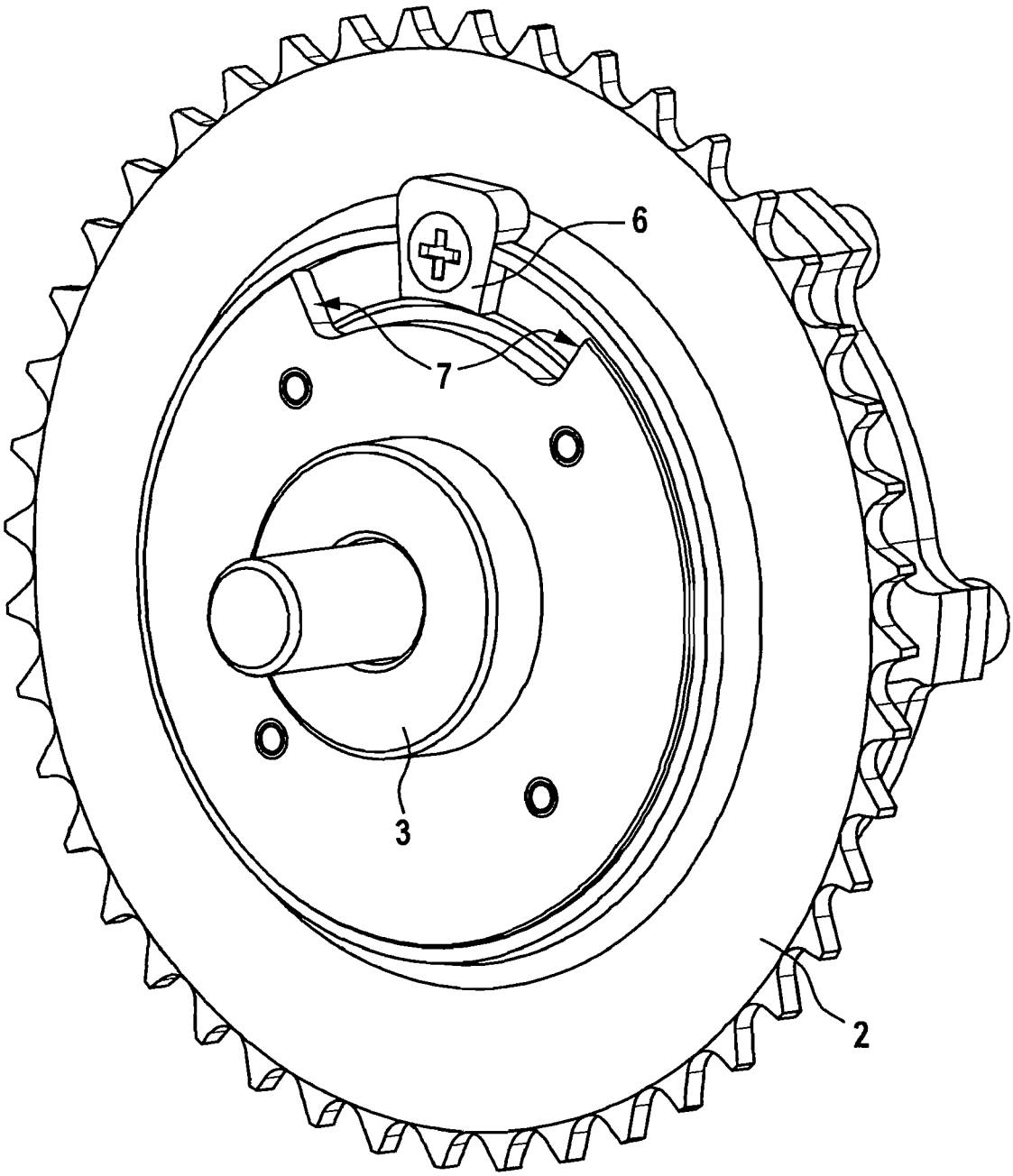
Figures 3, 4, 5, 6, 7, 8:
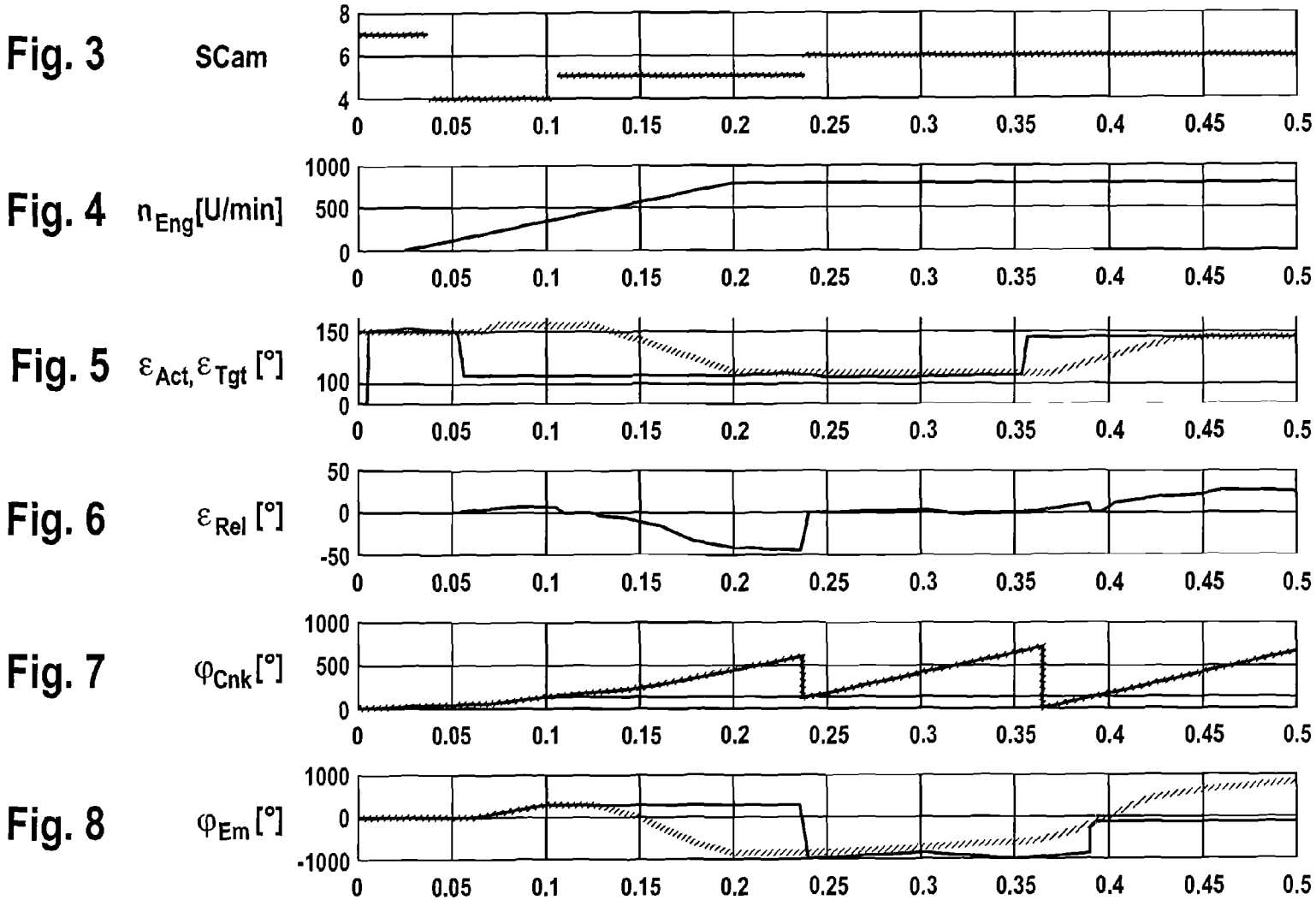
FIG. 6 a graphical representation of a phase angle signal related to a reference position, wherein time is plotted in seconds on the abscissa and the phase angle is plotted in degrees on the ordinate, FIG. 7 a graphical representation of the actual crankshaft rotational angle (non-dashed line) and a measurement signal (dashed line) for the crankshaft rotational angle, wherein time is plotted in seconds and the rotational angle is plotted in degrees on the ordinate, and FIG. 8 a graphical representation of the actual rotational angle (dashed line) of an electric motor, wherein time is plotted in seconds on the abscissa and the rotational angle is plotted in degrees on the ordinate.

An adjustment device for the rotational angle position of the camshaft 3 relative to the crankshaft 5 of a reciprocating piston internal combustion engine has, according to FIG. 1, an adjustment gear mechanism 1, which is constructed as a triple-shaft gear mechanism with a crankshaft-fixed drive shaft, a camshaft-fixed output shaft, and an adjustment shaft. The adjustment gear mechanism can be a rotary gear system, for example, a planetary gear system and/or wobble-plate gear system.

The drive shaft is locked in rotation with a camshaft gear 2, which is drivingly connected in a known way to a crankshaft gear locked in rotation on the crankshaft 5 of the internal combustion engine via a chain or a toothed belt. The output shaft is locked in rotation with the camshaft 3. The adjustment shaft is locked in rotation with the rotor of an electric motor 4. The adjustment gear mechanism 1 is integrated into the hub of the camshaft gear 2.

For limiting the rotation angle between the camshaft 3 and the crankshaft 5 of the internal combustion engine, the adjustment device has a stop element 6 connected rigidly to the output shaft of the adjustment gear mechanism 1 and a counter stop element 7, which is locked in rotation with the camshaft 3 and which comes into contact in the position of use on the stop element 6 in a reference position.

In FIG. 1 it can be seen that for measuring the crankshaft rotational angle, a magnetic detector 8 is provided, which detects the tooth flanks of a toothed ring 9 consisting of a magnetically conductive material and arranged on the crankshaft 5. One of the tooth gaps or teeth of the toothed ring 9 has a larger width than the other tooth gaps or teeth and marks a reference rotational angle position of the crankshaft 5.

When the internal combustion engine is started—independent of the position, in which the crankshaft 5 is located—a first rotational angle measurement signal is set to a rotational angle measurement signal start value, which can have the value of zero, for example. Then the crankshaft is set in rotation, e.g., by means of an electric starter motor and a crankshaft sensor signal, which changes its state each time a tooth flank of a toothed ring 9 passes by, is detected with the help of a magnetic detector 8. When a rising and/or falling flank (state change) of the crankshaft sensor signal appears, an interrupt is triggered in an operating program, in which the rotational angle measurement signal is advanced, for example, by incrementing.

When the reference rotational angle position is reached, a reference mark is generated in the sensor signal of the magnetic detector 8, which is also designated below as a crankshaft sensor signal. This is achieved in that the crankshaft toothed ring 9 has a larger gap at the reference rotational angle position than between its other teeth. As soon as the reference mark in the crankshaft sensor signal is detected, a second rotational angle measurement signal is set to a value allocated to the reference rotational angle position. Then the second rotational angle measurement signal is advanced for each rising and/or falling flank (state change) of the crankshaft sensor signal.

As an electric motor 4, an EC motor is preferably provided, which has a rotor, on whose circumference a series of magnetic segments are arranged, which are magnetized alternately in directions opposite each other and which interact magnetically via an air gap with teeth of a stator. The teeth are wrapped with a winding, which is energized via a control device.

The position of the magnetic segments relative to the stator and thus the adjustment shaft rotational angle is detected with the help of a measurement device, which has, on the stator, several magnetic field sensors 10, which are offset relative to each other in the circumferential direction of the stator, such that for each rotation of the rotor, a number of magnetic segment-sensor combinations is cycled through. The magnetic-field sensors 10 generate a digital sensor signal, which cycles through a sequence of sensor signal states that are repeated for one full mechanical rotation of the rotor as many times as the measurement device has magnetic-field sensors 10. This sensor signal is also designated below as an adjustment shaft sensor signal.

When the internal combustion engine is started—independent of the position, in which the rotor or the adjustment shaft is located—a position measurement signal is set to a position measurement signal start value. Then the adjustment shaft is turned, wherein for a change in state of the adjustment shaft sensor signal, an interrupt is triggered in the operating program of the control device, in which the position measurement signal is advanced.

As a reference signal generator for the camshaft rotational angle, an inductive sensor 11 is provided, which interacts with a trigger wheel 12 arranged on the camshaft 3. If the inductive sensor 11 detects a flank of the trigger wheel 12, an interrupt is triggered in an operating program of a control device, in which the crankshaft rotational angle and the adjustment shaft rotational angle are buffered for controlling the phase angle for further processing.

The rotational angle position of the camshaft relative to the crankshaft is designated below also as a phase position. This describes the time of the valve opening relative to the piston movement of the internal combustion engine. It is defined as follows:

$$\epsilon(t)=\phi_{Cnk}(t)-2\cdot\phi_{Cam}(t), \tag{1}$$

where $\phi_{Cnk}(t)$ signifies the crankshaft rotational angle at time t and $\phi_{Cam}(t)$ signifies the camshaft rotational angle at time t.

When the internal combustion engine is started, it is necessary to set a desired position of the phase angle as quickly as possible. This can be realized only with reference to a reference angle, because the phase angle can be determined only when the tooth gap or tooth marking the reference rotational angle position is found and a flank of the camshaft is identified.

After the internal combustion engine is started, initially a stop movement is performed, in which two strategies are conceivable:

a) The stop element is controlled in the direction of the counter stop element with the help of the electric motor 4 with a given force until the reference position is reached.

b) The phase velocity is controlled to a given desired phase velocity until the reference position is reached.

The phase angle can be decomposed into two parts during the stop movement:

$$\epsilon(t)=[\phi_{Cnk}^{(0)}-2\cdot\phi_{Cam}^{(0)}]+([\phi_{Cnk}(t)-\phi_{Cnk}^{(0)}]+2\cdot[\phi_{Cam}(t)-\phi_{Cam}^{(0)}])=\epsilon^{(0)}+\epsilon_{Rel}(t). \quad (2)$$

Here $\phi^{(0)}_{Cnk}(t)=\phi_{Cnk}(t_0)$ the crankshaft rotational angle at the start of the stop movement phase, $\phi^{(0)}_{Cam}(t)=\phi_{Cam}(t_0)$ the camshaft rotational angle at the start of the stop movement phase, $\gamma^{(0)}_{Cnk}(t)=\epsilon_{Cnk}(t_0)$ the phase angle at the start of the stop movement phase, and $\epsilon_{Rel}(t)$ the phase angle that was adjusted from the beginning of the stop movement phase to the current time t. It can also be designated as a relative percentage of the phase angle relative to the start phase angle.

Because the measurement device for the rotational angle of the rotor of the electric motor 4 has a higher resolution than the inductive sensor 11 of the camshaft 3, the rotational angle of the camshaft 3 is not calculated directly, but instead with the help of the gear equation of the adjustment gear mechanism 1 from the position measurement signal. From this and from equation (1) is given the following formula for determining the relative percentage of the phase angle:

$$\varepsilon_{Rel}(t)=\frac{1}{-i_g}(2\cdot[\varphi_{Em}(t)-\varphi_{Eam}^{(0)}]-[\varphi_{Cnk}(t)-\varphi_{Cnk}^{(0)}]) \quad (3)$$

Here $\phi^{(0)}_{Em}(t)=\phi_{Em}(t_0)$ the rotational angle of the rotor of the electric motor at the start of the stop movement phase, $\phi_{Em}(t)$ the rotational angle of the rotor from the beginning of the stop movement phase up to the current time t.

When the internal combustion engine starts, $\epsilon^{(0)}$ is unknown. Consequently, the current phase angle $\epsilon(t)$ during this phase is also unknown. For this phase, only the relative percentage of the phase angle is required. This is used to calculate the phase velocity, which is necessary for phase velocity control during the stop movement, if strategy b) is used (see above). In addition, the relative percentage of the phase angle is used for finding the reference position. When the reference position is reached, the phase angle and thus its relative percentage remains approximately constant, although the electric motor is energized even farther in this direction.

After the drop in the rate of change of the phase angle signal appearing when the reference position is reached is detected and the reference position is identified, the phase angle with the reference position is controlled as the desired value and the first rotational angle measurement signal as the actual value signal until conditions explained in more detail below for controlling the phase angle are fulfilled with the second rotational angle measurement signal as the desired value signal. The phase angle can also be decomposed here again into two parts:

$$\epsilon(t)=\epsilon_{HStop}+\epsilon_{Rel}(t) \quad (4)$$

where $\epsilon_{HStop}$ is the phase angle at the reference stop and $\epsilon_{Rel}(t)$ is the phase angle, which was adjusted from the beginning of the control phase, at which the first rotational angle measurement signal is used as the actual value signal, until the current time t. It is the relative percentage of the phase angle relative to the reference position. This relative percentage of phase angle can be calculated in turn with the help of the gear equation of the adjustment gear mechanism:

$$\varepsilon_{Rel}(t)=\frac{1}{-i_g}(2\cdot[\varphi_{Em}(t)-\varphi_{Em,HStop}]-[\varphi_{Cnk}(t)-\varphi_{Cnk,HStop}]), \quad (5)$$

where $\phi_{Em,HStop}=\phi_{Em}(t)$ is the rotational angle of the electric motor rotor at the start of the control phase, at which the first rotational angle measurement signal is used as an actual value signal, $\phi_{Cnk,HStop}(t)=\phi_{Cnk}(t_{Hstop})$ is the rotational angle of the electric motor rotor at the start of the control phase, at which the first rotational angle measurement signal is used as the actual value signal, $\phi_{Em}(t)$ is the rotational angle of the electric motor rotor from the beginning of the control phase, at which the first rotational angle measurement signal is used as an actual value signal up to the current time t, and $\phi_{Cnk}(t)$ is the crankshaft rotational angle from the beginning of the control phase, at which the first rotational angle measurement signal is used as an actual value signal up to the current time t.

After the reference marks have been detected in the crankshaft sensor signal and the camshaft reference signal, the rotational speed of the internal combustion engine exceeds 500 rpm, and the phase angle lies in a plausible range, the phase angle with the second crankshaft rotational angle measurement signal is controlled as the actual value signal. During this phase of the control, the phase angle is determined by $$\varepsilon_{Rel}(t)=\varepsilon_{Abs}+\frac{1}{-i_g}\left(\begin{array}{c}2\cdot[\varphi_{Em,ICyc}-\varphi_{Em,ICam}]-\\[\varphi_{Cnk,ICyc}-\varphi_{Cnk,ICam}]\end{array}\right), \quad (6)$$

Here $\phi_{Em,ICyc}=\phi_{Em}(t_{ICyc})$ the rotational angle of the electric motor rotor from the last recognition of the reference mark up to the current cyclical interrupt, $\phi_{Cnk,ICyc}=\phi_{Cnk}(t_{ICyc})$ the crankshaft rotational angle from the last recognition of the reference mark up to the current cyclical interrupt, $\phi_{Em,ICam}$ the rotational angle of the electric motor rotor from the last recognition of the reference mark up to the last cyclical interrupt, $\phi_{Cnk,ICam}$ the crankshaft rotational angle from the last recognition of the reference mark up to the last cyclical interrupt, $\epsilon_{Abs}$ the phase angle, at which each cyclical interrupt is determined and equals the crankshaft rotational angle at the time of the appearance of the camshaft reference signal.

The rotational speed threshold of 500 rpm ensures that the phase angle control with the second rotational angle measurement signal is performed as the desired value signal only in a motor rotational speed range, in which the flanks of the teeth of the crankshaft toothed ring 9, the reference mark, and the camshaft reference signal can be reliably detected. In addition, the phase angle control is performed with the second rotational angle measurement signal as the desired value signal only when the phase angle that was determined with the help of the second crankshaft rotational angle signal lies in the adjustment range of the adjustment device. An implausible phase angle can be caused by a hardware defect (e.g., stop defect), measurement signal detection errors (e.g., incorrect flank detection on the crankshaft toothed ring 9), or signal processing (incorrect detection of the reference mark, incorrect advancing of the rotational angle measurement signal, etc.). Such error cases are handled through suitable emergency measures.

The start strategy described above can be summarized as follows:

a) After the engine start (i.e., after the starter signal jumps from zero to one) until a crankshaft rotational speed measurement value is detected: preset the electric motor 4 in the direction of the reference position with a pulse width-modulation ratio of 20%.

b) After a crankshaft rotational speed measurement value is detected, the electric motor 4 is positioned with a pulse width-modulation ratio dependent on at least one operating parameter of, e.g., 30% in the direction of the reference position with a given velocity and a limitation of its operating current and its operating voltage. For this and also for the stop recognition, the phase angle according to equation (3) is calculated. This phase of the control is ended when the stop is reached or recognized or is interrupted when the conditions for a phase position control with the second crankshaft rotational angle signal is fulfilled as the desired value signal.

c) After the reference position is recognized, the phase angle is controlled relative to the reference position. For this, the phase angle at the stop must be known. The current phase angle is calculated by means of equations (4) and (5). This phase of the control is interrupted when the stop is reached and recognized or is interrupted when the conditions for a phase position control are fulfilled with the second crankshaft rotational angle signal as the desired value signal and the stop has not yet been reached.

d) The phase position control is performed with the second crankshaft rotational angle signal as the desired value signal, as soon as the following conditions have been satisfied: the engine rotational speed of the internal combustion engine is greater than or equal to 500 rpm, the reference mark is recognized, and the phase angle determined with the help of the second crankshaft rotational angle signal lies in a plausible range. For this control, the phase angle is calculated by means of equation (6).

Below the method is explained with reference to the simulation results shown in FIGS. 4 to 8. Here, for the stop movement the strategy of phase velocity control is used.

At the time t=0.02 s, the internal combustion engine is started. The engine rotational speed reaches the value of 800 rpm at t=0.2 s and remains constant from there up to the end of the simulation. At t=0.0375 s, the stop movement is begun (SCam=4), because the engine rotational speed of 50 rpm is reached at this point. At this point, the crankshaft rotational angle relative to the engine start position has a value of 70 and the rotational speed of the electric motor has a value of 0°. These values are used as reference angles $\phi^{(0)}_{Em}$ and $\phi^{(0)}_{Cnk}$ for the calculation of the phase angle according to equation (3). After the stop is reached at time t=0.08 s, it stays 25 ms until it is recognized (t=0.105 s). For the stop movement, a start phase angle of 148° of the crankshaft is assumed.

At t=0.105 s, the phase angle is controlled relative to the reference position (SCam=5). The values that the crankshaft rotational angle ($\phi_{Cnk}$=106°) and the rotor rotational angle ($\phi_{Em}$=213.5°) have at the time, are used during this phase as the reference angles $\phi_{Cnk,HStop}$ and $\phi_{Cnk,HStop}$ for the calculation of the phase angle according to equation (5). Here, the phase angle at the reference position equals 154°, see equation (4).

The control with the second crankshaft rotational angle signal as the desired value signal is begun at t=0.2375 s (SCam=6), after the rotational speed threshold of 500 rpm is reached at t=0.135 s and the first reference mark at t=0.125 s and also a flank of the camshaft reference signal are detected. At the start of the phase, the phase angle $\epsilon_{Abs}$ determined with the help of the second rotational angle measurement signal has the value 107.5° and the value 119.5° at the next occurrence of the flank of the camshaft reference signal (t=0.39 s).

Thus, the invention relates to a method for adjusting the rotational angle position of the camshaft 3 of a reciprocating piston engine relative to the crankshaft 5. The crankshaft 5 is drivingly connected to the camshaft 3 via an adjustment gear mechanism 1, which is embodied as a triple-shaft gear mechanism with a crankshaft-fixed drive shaft, a camshaft-fixed output shaft, and an adjustment shaft drivingly connected to an electric motor 4. A stop element 6 is connected to the drive shaft and a counter stop element 7, which interacts with the stop element 6 at least in a reference position, is connected to the camshaft 3. In the starting process of the internal combustion engine, a crankshaft rotational angle measurement signal and a position measurement signal for the rotational angle of the adjustment shaft are detected. With the help of the rotational angle measurement signal, the position measurement signal, and a gear parameter of the triple-shaft gear mechanism, a phase angle signal for the rotational angle position of the camshaft 3 relative to the crankshaft 5 with reference to the start position is determined. After the stop element 6 is positioned against the counter stop element 7 and the attainment of the reference position has been detected, the phase angle relative to the reference position is measured and controlled to a desired value signal.

LIST OF REFERENCE SYMBOLS

1 Adjustment gear mechanism
2 Camshaft gear
3 Camshaft
4 Electric motor
5 Crankshaft
6 Stop element
7 Counter stop element
8 Magnetic detector
9 Toothed ring
10 Magnetic-field sensor
11 Inductive sensor
12 Trigger wheel

The invention claimed is:

1. A method for adjusting the rotational angle position of the camshaft of a reciprocating piston internal combustion engine relative to the crankshaft during a startup process of the internal combustion engine, wherein the crankshaft is drivingly connected to the camshaft via an adjustment gear mechanism, which is embodied as a triple-shaft gear mechanism with a crankshaft-fixed drive shaft, a camshaft-fixed output shaft, and an adjustment shaft drivingly connected to an electric motor, the method comprising:

a) setting a rotational angle measurement signal is set to a rotational angle measurement start value, b) rotating the crankshaft and detecting a crankshaft sensor signal, which changes its state for a change in a rotational angle of the crankshaft (5), c) advancing the rotational angle measurement signal for an appearance of a state change of the crankshaft sensor signal, d) setting a position measurement signal to a position measurement signal start value, e) rotating the adjustment shaft and detecting an adjustment shaft sensor signal, which changes its state for a change in the rotational position of the adjustment shaft, f) wherein for an appearance of a state change of the adjustment shaft sensor signal, advancing the position measurement signal, g) wherein based on the rotational angle measurement signal, the position measurement signal, and a gear parameter of the adjustment gear mechanism, determining a phase angle signal for the rotational angle position of the camshaft relative to the crankshaft, h) wherein the crankshaft and the camshaft are braced relative to each other in a reference position and detecting the attainment of the reference position, i) wherein when the reference position is detected, setting, the phase angle signal to a reference value allocated to the reference position, k) then advancing the phase angle signal for a state change of the rotational angle measurement signal and/or the position measurement signal, l) and controlling the phase angle, in that the reference position-related phase angle signal obtained in this way is compared with a desired value signal and for an appearance of a deviation in the phase angle, the electric motor is controlled such that the deviation is reduced.

2. The method according to claim 1, wherein a stop element connected to the drive shaft is positioned against a counter stop element connected to the camshaft for bracing the crankshaft with the camshaft.

3. The method according to claim 1, wherein the crankshaft and the camshaft are braced with each other with assistance from a spring element.

4. The method according to claim 1, wherein the attainment of the reference position is detected with reference to a change in a rate of change of the phase angle signal.

5. The method according to claim 1, further comprising when a given reference rotational angle position of the crankshaft is reached, generating a reference mark in the crankshaft sensor signal, and when the reference mark appears, setting a second rotational angle measurement signal to a value allocated to the reference rotational angle position, advancing the second rotational angle measurement signal when a state change of the crankshaft sensor signal appears, and when a given rotational angle position of the camshaft is reached generating a camshaft reference signal, the measurement values of the rotational angle measurement signal and the position measurement signal present at the appearance of the camshaft reference signal and with these measurement values and a gear parameter, determining a value for an absolute phase angle signal, measuring and comparing the rotational speed of the internal combustion engine with a given rotational speed threshold and control of the phase angle with the absolute phase angle signal is continued as an actual value signal when the rotational speed threshold is exceeded.

6. The method according to claim 5, wherein the absolute phase angle signal is compared with a given value range and the control of the phase angle is continued with the absolute phase angle signal only if the phase angle signal lies in the given value range.

7. The method according to claim 6, wherein initially at least one rotational speed measurement value is detected for the rotational speed of the crankshaft and then the control of the phase angle is continued only with the absolute phase angle signal.

8. The method according to claim 1, wherein before the stop element is positioned against the counter stop element, the electric motor is controlled through pulse-width modulation with a given pulse-to-no-current ratio in a direction towards the reference position.

9. The method according to claim 8, wherein the pulse-to-no-current ratio is changed as a function of the detection of the rotational speed measurement value, wherein the pulse-to-no-current ratio is increased as soon as the rotational speed measurement value is detected.

10. The method according to claim 1, further comprising before the stop element is positioned against the counter stop element, differentiating the phase angle signal for forming a phase velocity signal, comparing the phase velocity signal with a phase velocity threshold value, and for the case that the phase velocity signal is greater than the threshold value, the phase velocity signal is compared with a desired value signal and is controlled when a deviation of the electric motor appears, such that the deviation is reduced.

11. The method according to claim 1, wherein before the attainment of the reference position is detected, at least one of an operating current, an operating voltage or a rotational speed of the electric motor is limited or controlled.

* * * * *